US005791701A

United States Patent [19]

Daoud

[11] Patent Number: 5,791,701

[45] Date of Patent: Aug. 11, 1998

[54] SECURITY LATCH MECHANISM

[75] Inventor: Bassel H. Daoud, Parsippany, N.J.

[73] Assignee: Lucent Technologies Inc., Murray Hill, N.J.

[21] Appl. No.: 696,309

[22] Filed: Aug. 13, 1996

[51] Int. Cl.[6] ..... E05C 19/10

[52] U.S. Cl. ..... 292/129; 292/98; 292/256.73

[58] Field of Search ..... 292/129, 98, 177, 292/155, 256.71, 256.73, DIG. 11, 95, 256, 115, 96

[56] References Cited

U.S. PATENT DOCUMENTS

| | | | |
|---|---|---|---|
| 1,327,011 | 1/1920 | Arndt | 292/256.73 X |
| 1,537,712 | 5/1925 | Specht | 292/155 X |
| 1,762,578 | 6/1930 | Hiser | 292/256.73 X |
| 2,860,904 | 11/1958 | Barry et al. | 292/256 |
| 2,952,488 | 9/1960 | Appleton | 292/256.73 |
| 3,938,837 | 2/1976 | Bright | 292/155 X |
| 4,373,877 | 2/1983 | Brown | 292/256 X |

FOREIGN PATENT DOCUMENTS

| | | | |
|---|---|---|---|
| 1192549 | 5/1965 | Germany | 292/256 |

OTHER PUBLICATIONS

Over–center Draw Latch Series 60, Southco, Inc., Concordville, PA 19331.

Over–center Draw Latch Series 70, Southco, Inc., Concordville, PA 19331.

*Primary Examiner*—Rodney M. Lindsey

[57] ABSTRACT

A security latch mechanism suited for use with a splice chamber in a building telephone entrance terminal. The mechanism includes a latch member having a hook at its top end for engaging a splice chamber cover. A stem arrangement including a fastening member joins a bottom end of the latch member to part of the entrance terminal while permitting the latch member to move between a latch open position and a latch closed position. A spring mechanism associated with the fastening member urges the latch member toward the open position. The fastening member has a head for governing movement of the latch member, wherein the latch member advances toward the entrance terminal and its hook engages the splice chamber cover to define the latch closed position when the fastening member head is operated in a first sense, and the latch member advances toward the splice chamber cover and the hook disengages the cover to define the latch open position when the fastening member is operated in a second sense.

16 Claims, 3 Drawing Sheets

SECURITY LATCH MECHANISM

BACKGROUND OF THE INVENTION

1. Field of the Invention

The present invention relates generally to latch mechanisms, and particularly to a compact latch mechanism having a security feature.

1. Description of the Known Art

Latch mechanisms usually include a latch member with a hook at one end for engaging part of a structure to be latched closed, for example, the edge of a hinged box cover. A lever at the other end of the mechanism is pivoted on another part of the structure, and acts to close the cover by drawing the latch down as the lever is operated. Examples of such latches are the Series 60 and Series 70 "Over-center" draw latches available from Southco, Inc. of Concordville, Pa. 19331.

A problem with common draw latches is that the overall length of the mechanism including the latch member and associated lever is great, with respect to the distance the hook is moved linearly by operation of the lever. Further, unless a key-lock is combined with the draw latch, the latch lever remains accessible and can be easily operated, leaving no security against unauthorized access to the contents of the latched structure.

A need therefore exists for a latch mechanism of relatively small dimensions for application in close mechanical environments, and which offers security to the user as well.

SUMMARY OF THE INVENTION

According to the invention, a security latch mechanism includes latch means with hook means at a top end for engaging a first part of a structure to be latched, and stem means including a fastening member for joining a bottom end of the latch means to a second part of the structure to be latched while permitting the latch means to move between a latch open position and a latch closed position. The stem means includes bias means associated with the fastening member for urging the latch means toward the open position. The fastening member has a head for governing movement of the latch means, wherein the latch means advances toward the second part of the structure and the hook means engages the first part of the structure to define the latch closed position when the fastening member head is operated in a first sense, and the latch means advances toward said first part and the hook means disengages the first part to define the latch open position when the head is operated in a second sense.

The various features of novelty that characterize the invention are pointed out with particularity in the claims annexed to and forming a part of the present disclosure. For a better understanding of the invention and its operating advantages, reference is made to the accompanying drawing and descriptive matter in which a preferred embodiment of the invention is illustrated and described.

DETAILED DESCRIPTION OF THE INVENTION

Figure 1:
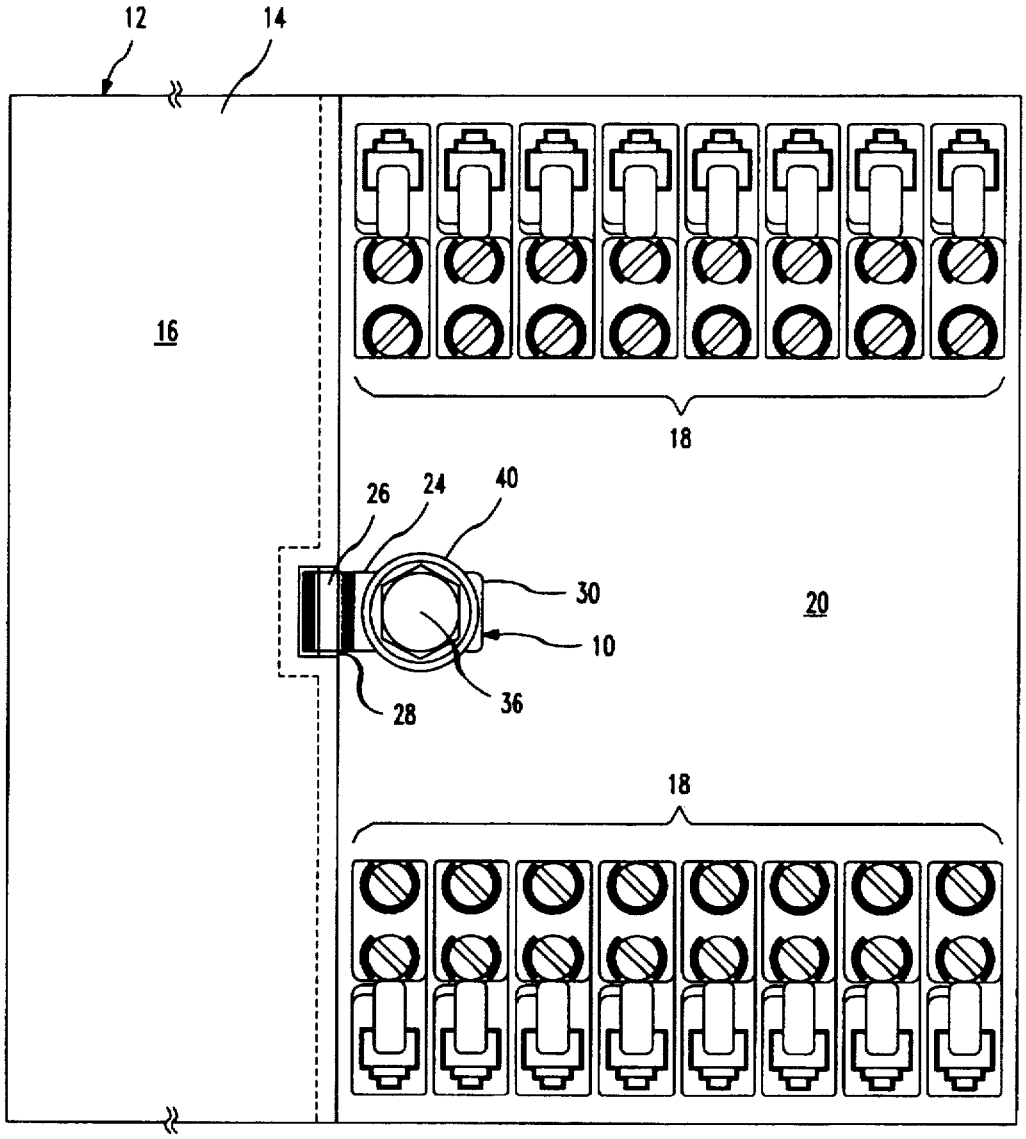
FIG. 1 is a top view of a covered splice chamber showing a cover latch mechanism according to the invention.

FIG. 1 is a top view of a latch mechanism 10 according to the invention. In the illustrated embodiment, the latch mechanism 10 is provided inside a telephone wiring cabinet or building entrance terminal (BET) 12. The terminal 12 has a covered splice chamber 14, a cover 16 of which is securely latched to the body of the splice chamber 14 by the latch mechanism 10. Arrays of telephone customer bridge terminals 18 are mounted outside the splice chamber 14 at regularly spaced intervals on a mounting panel 20. A separate cover (not shown) may also be provided to cover the entire terminal 12. Such a terminal cover could be opened by the telephone customer, for example, to gain access to the bridge terminals 18 for testing the telephone wiring on the customer's premises.

Figure 2:
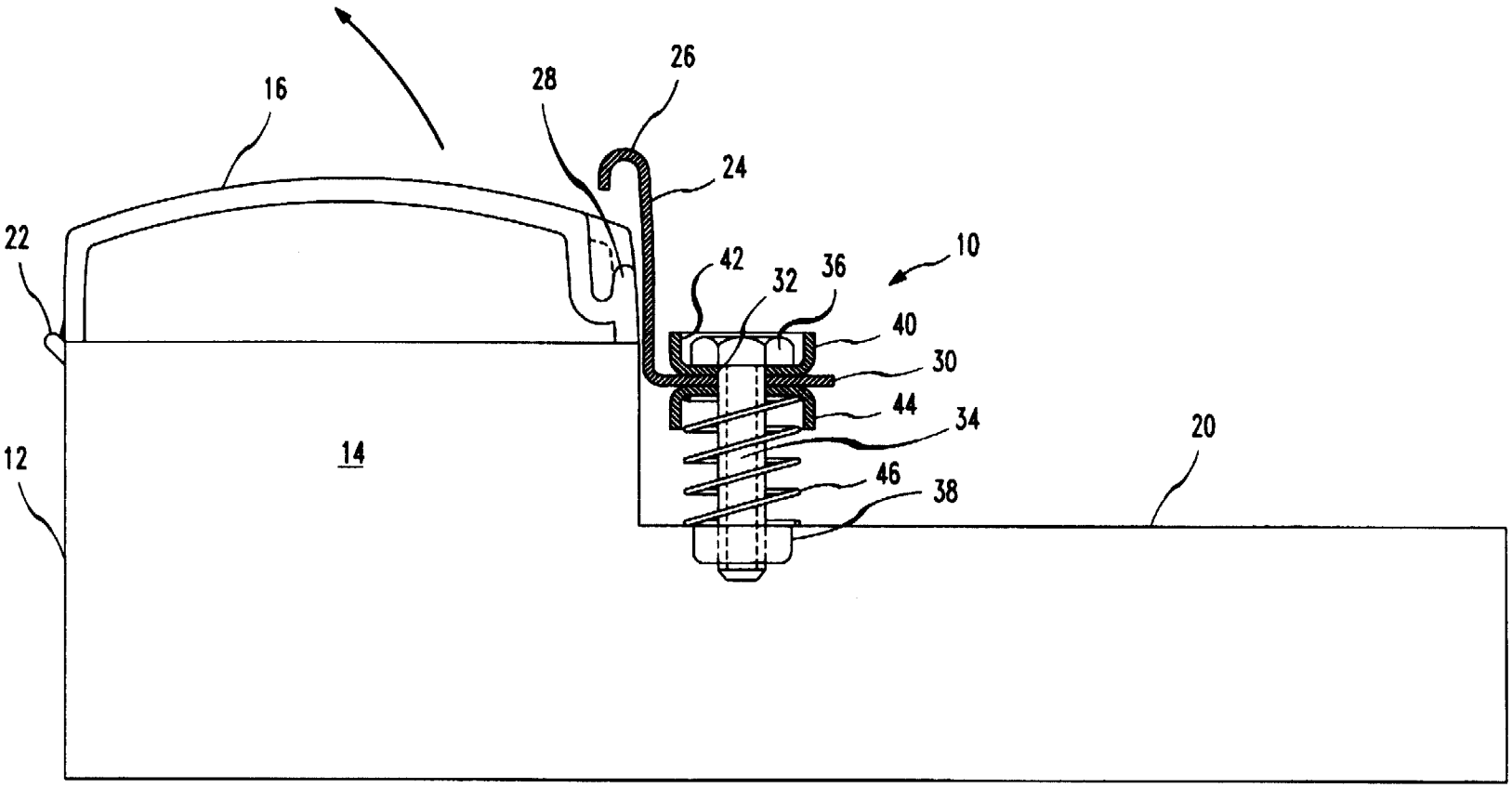
FIG. 2 is a side view of the latch mechanism in FIG. 1; shown in a latch open position.
Figure 3:
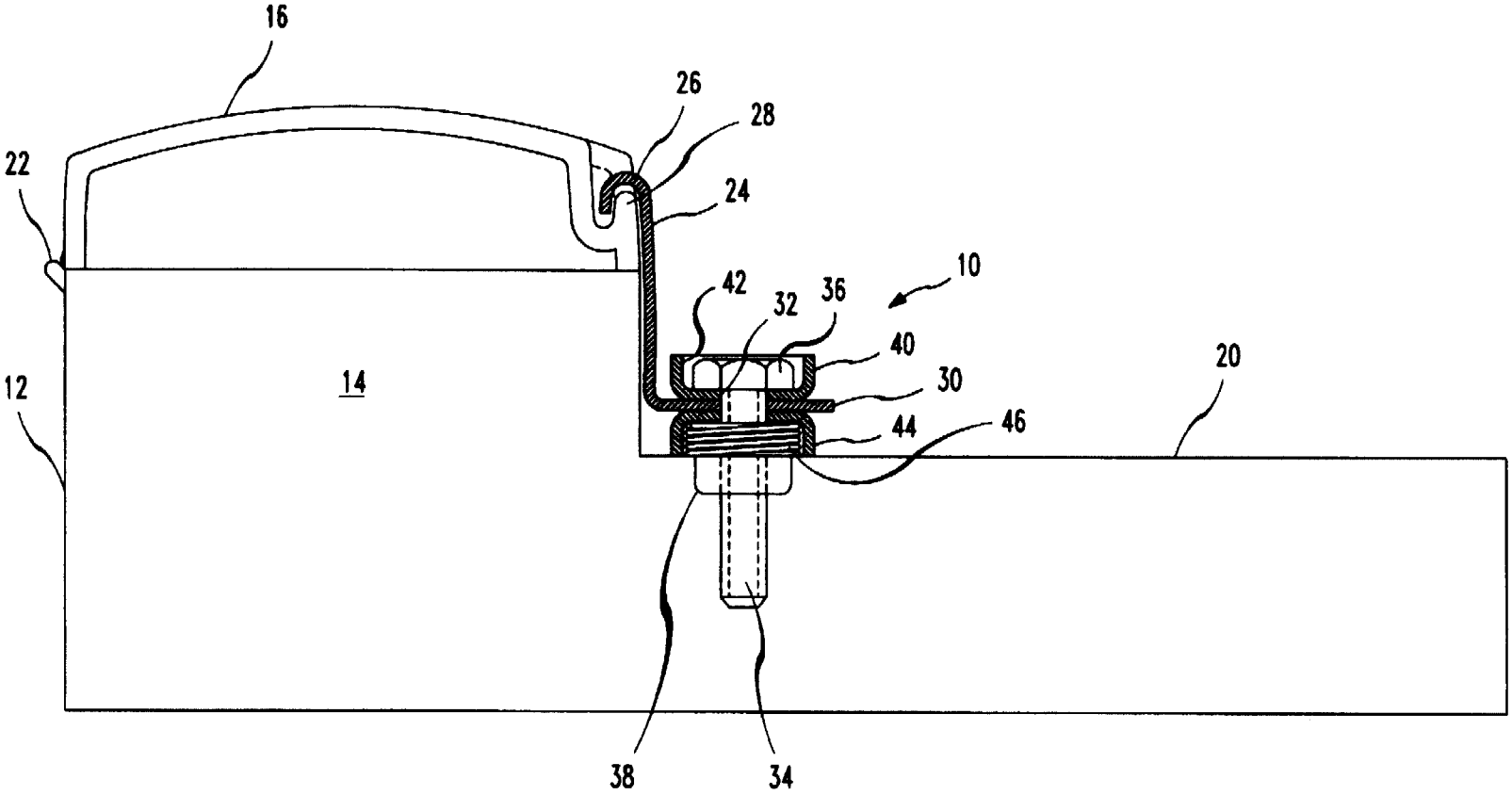
FIG. 3 is a side view of the latch mechanism in FIG. 1; shown in a latch closed position.

The splice chamber 14 has a generally rectangular configuration, and the chamber cover 16 is secured to the body of the terminal 12 by one or more hinges 22 at the left side of cover 16, as viewed in FIGS. 1–3.

It is important for the splice chamber 14 to remain inaccessible to the telephone customer or end user, to prevent the customer from tampering with splicing connectors and wiring (not shown) located on the telephone network side of the building entrance terminal 12. As mentioned, the entrance terminal 12 is constructed to allow the end user to access only the bridge terminals 18 or "customer side" of the terminal 12. Access to the interior of the splice chamber 14 is guarded by the present latch mechanism 10, as explained below.

As shown in FIGS. 1–3, the latch mechanism 10 includes a generally L-shaped latch member 24 having a hook part 26 at a top end of the latch member 24, for engaging a protrusion 28 that is formed on an edge of the splice chamber cover 16. The latch member 24 may be made of, e.g., sheet metal with the hook part 26 and a bottom end part 30 formed as a single piece. The bottom end part 30 has an opening 32 for passage of a fastening member 34. The fastening member 34 has a head 36, and the lower body of the fastening member 34 engages a threaded, clinched type nut 38 that is captured in the mounting panel 20 of the entrance terminal 12.

A top cup washer 40 is positioned between the fastening member head 36 and the bottom end part 30 of the latch member 24. The cup washer 40 faces upward to define a relatively narrow annular gap between the inner surface of the wall of the washer 40, and the periphery of the fastening member head 36. The gap 42 is preferably just sufficient to permit a telephone security tool, e.g., a type 216C thin-wall socket driver to enter the gap 42 and engage the head 36, so that the fastening member 34 can be turned by the tool in either sense of rotation.

A bottom cup washer 44 is located beneath the bottom end part 30 of the latch member 24, and the washer 44 faces downward to seat a compression coil spring 46. The spring 46 surrounds the body of the fastening member 34, and the bottom of spring 46 abuts the surface of the bridge connector mounting panel 20. The washer 44 and the spring 46 are dimensioned and arranged such that the spring 46 will not be damaged by an excess compressive force when the fastening member 34 is fully tightened in the nut 38 (see FIG. 3). That is, the depth of the wall of the cup washer 44 is at least as great as the height of the spring 46 when the latter is compressed to a safe limit.

The height of the latch member 24 as viewed in FIGS. 2 and 3, is such that when the fastening member 34 is fully loosened in the nut 38 (FIG. 2), the hook part 26 disengages the protrusion 28 on the splice chamber cover 16 as the spring 46 urges the cup washer 44 and the bottom end part 30 of the latch member upward, in unison with the top cup washer 40 and the fastening member head 36. When the hook part 26 is fully disengaged from the protrusion 28 at the edge of the cover 16, cover 16 is free to swing open in a counter-clockwise direction as viewed in FIG. 2, i.e., the cover protrusion 28 should swing free of the hook part 26 when the cover 16 is fully unlatched.

The height of the latch member 24 and the form of the hook part 26 are also defined so that when the fastening member 34 is fully tightened in the mounting panel nut 38, the bottom end part 30 of the latch member is urged downward against the force of spring 46 by the fastening member head 36 acting through cup washer 40, and the hook part 26 of latch member 24 engages the cover protrusion 28 to close the cover 16 firmly atop splice chamber 14. As mentioned, the wall of the bottom cup washer 44 also prevents permanent deformation of the spring 46 that might otherwise be caused by over-tightening the fastening member 34.

While the foregoing description represents a preferred embodiment of the invention, it will be obvious to those skilled in the art that various changes and modifications may be made, without departing from the spirit and the scope of the invention as pointed out by the following claims.

What I claim is:

1. A latch mechanism, comprising:

a generally L-shaped latch member having a hook at a top end of the latch member for engaging a first part of a structure to be latched, and a bottom end part; and a stem arrangement including an elongate fastening member for joining the bottom end part of the latch member to a second part of the structure to be latched while permitting the latch member to move in the direction of the length of the fastening member between a latch open position and a latch closed position, wherein the fastening member has a lower body arranged to engage threadably the second part of said structure, and a bias arrangement for urging said latch member toward said open position; and said fastening member has a head for governing movement of said latch member, wherein said latch member will advance toward the second part of said structure and the hook will engage the first part of said structure to define the latch closed position when the fastening member head is rotated in a first sense with respect to said second part, and said latch member will advance toward the first part of said structure and the hook will disengage said first part to define the latch open position when said head is rotated in a second sense with respect to said second part.

2. A latch mechanism according to claim 1, wherein said bias arrangement comprises a coil spring placed coaxially about the elongated fastening member, for being located between the bottom end part of the latch member and the second part of said structure.

3. A latch mechanism according to claim 2, including a bottom cup washer located between the bottom end part of the latch member and a top end of said coil spring, wherein the cup washer has a wall depth at least as great as a height of the coil spring when said spring is compressed to a safe limit.

4. A latch mechanism according to claim 1, wherein said stem arrangement comprises a security device associated with said fastening member, for limiting access to said fastening member to a particular tool.

5. A latch mechanism according to claim 4, wherein said security arrangement comprises a top cup washer located between the bottom end part of said latch member and the head of said fastening member.

6. A latch mechanism according to claim 5, wherein said top cup washer defines a relatively narrow gap between an inner wall surface of the cup washer and the periphery of the fastening member head.

7. A latch mechanism according to claim 1, including a nut member for being fixed with respect to the second part of said structure for engaging the lower body of said fastening member.

8. A building entrance terminal with a secure splice chamber, comprising:

a building entrance terminal portion which includes a splice chamber body;

a splice chamber cover dimensioned and arranged to prevent access to the interior of the splice chamber body;

a generally L-shaped latch member having a hook at a top end of the latch member for engaging a part of said cover, and a bottom end part; and a stem arrangement including an elongate fastening member for joining the bottom end part of the latch member to said entrance terminal portion while permitting the latch member to move in the direction of the length of the fastening member between a latch open position and a latch closed position, wherein the fastening member has a lower body arranged to engage threadably the entrance terminal portion, and a bias arrangement for urging said latch member toward said open position; and said fastening member has a head for governing movement of said latch member, wherein the latch member advances toward the building entrance terminal portion and the hook engages the splice chamber cover to define the latch closed position when the fastening member head is rotated in a first sense with respect to said terminal portion, and said latch member advances toward the splice chamber cover and the hook disengages the cover to define the latch open position when said head is rotated in a second sense with respect to said terminal portion.

9. A building entrance terminal according to claim 8, wherein said bias arrangement comprises a coil spring located coaxially about the elongated fastening member, between the bottom end part of the latch member and said entrance terminal portion.

10. A building entrance terminal according to claim 9, including a bottom cup washer located between the bottom end part of the latch member and a top end of said coil spring, wherein the cup washer has a wall depth at least as great as a height of the coil spring when said spring is compressed to a safe limit.

11. A building entrance terminal according to claim 8, including a nut member fixed with respect to said entrance terminal portion for engaging the lower body of said fastening member.

12. A building entrance terminal according to claim 8, wherein said stem arrangement comprises a security device associated with said fastening member, for limiting access to said fastening member to a particular tool.

13. A building entrance terminal according to claim 12, wherein said security arrangement comprises a top cup washer located between the bottom end part of said latch member and the head of said fastening member.

14. A building entrance terminal according to claim 13, wherein said top cup washer defines a relatively narrow gap between an inner wall surface of the cup washer and the periphery of the fastening member head.

15. A latch mechanism, comprising:

latch means for engaging a first part of a structure to be latched having hook means at a top end of the latch means for engaging the first part of the structure to be latched; and stem means for engaging said latch means including a fastening member for joining a bottom end of the latch means to a second part of the structure to be latched while permitting the latch means to move between a latch open position and a latch closed position, and bias means associated with the fastening member for urging said latch means toward said open position;

wherein said fastening member has a head for governing movement of said latch means so that the latch means will advance toward the second part of said structure and the hook means will engage the first part of said structure to define the latch closed position when the fastening member head is operated in a first sense, and said latch means advances toward the first part of said structure and the hook means disengages said first part to define the latch open position when said head is operated in a second sense;

said bias means comprising a coil spring for being located between the bottom end of the latch means and the second part of said structure; and a bottom cup washer located between the bottom end of the latch means and a top end of said coil spring, wherein the cup washer has a wall depth at least as great as a height of the coil spring when said spring is compressed to a safe limit.

16. A building entrance terminal with a secure splice chamber, comprising:

a building entrance terminal portion which includes a splice chamber body;

a splice chamber cover dimensioned and arranged to prevent access to the interior of the splice chamber body;

latch means for engaging a part of said cover having hook means at a top end of the latch means for engaging said part of said cover; and stem means for engaging said latch means including a fastening member for joining a bottom end of the latch means to said entrance terminal portion while permitting the latch means to move between a latch open position and a latch closed position, and bias means associated with the fastening member for urging said latch means toward said open position; and said fastening member has a head for governing movement of said latch means wherein the latch means advances toward the building entrance terminal portion and the hook means engages the splice chamber cover to define the latch closed position when the fastening member head is operated in a first sense, and said latch means advances toward the splice chamber cover and the hook means disengages the cover to define the latch open position when said head is operated in a second sense;

wherein said bias means comprises a coil spring located between the bottom end of the latch means and said entrance terminal portion, and a bottom cup washer located between the bottom end of the latch means and a top end of said coil spring, wherein the cup washer has a wall depth at least as great as a height of the coil spring when said spring is compressed to a safe limit.

* * * * *